US006840144B2

(12) United States Patent
Huang

(10) Patent No.: US 6,840,144 B2
(45) Date of Patent: Jan. 11, 2005

(54) QUICK-DETACHABLE BLADE GUARD MOUNTING STRUCTURE

(75) Inventor: Peter Huang, Taichung (TW)

(73) Assignee: Durq Machinery Corp., Taichung (TW)

( * ) Notice: Subject to any disclaimer, the term of this patent is extended or adjusted under 35 U.S.C. 154(b) by 0 days.

(21) Appl. No.: 10/196,241

(22) Filed: Jul. 17, 2002

(65) Prior Publication Data

US 2004/0011177 A1 Jan. 22, 2004

(51) Int. Cl.[7] ..... B27G 19/02; B27B 5/29

(52) U.S. Cl. ..... 83/102.1; 83/440.2; 83/477.2; 83/478

(58) Field of Search ..... 83/102.1, 440.2, 83/477.2, 478, 544, 860, DIG. 1; 409/134; 451/454, 455

(56) References Cited

U.S. PATENT DOCUMENTS 2,095,330 A * 10/1937 Hedgpeth ..... 83/102.1
2,163,320 A * 6/1939 Hammond ..... 83/102.1
2,466,325 A * 4/1949 Ocenasek ..... 83/102.1
2,593,596 A * 4/1952 Olson ..... 83/102.1
2,786,496 A * 3/1957 Eschenburg ..... 83/102.1
3,754,493 A * 8/1973 Niehaus et al. ..... 83/478
3,808,932 A * 5/1974 Russell ..... 83/478
4,625,604 A * 12/1986 Handler et al. ..... 83/102.1
6,109,157 A * 8/2000 Talesky ..... 83/477.2 X
6,170,370 B1 * 1/2001 Sommerville ..... 83/102.1
6,405,624 B2 * 6/2002 Sutton ..... 83/102.1
6,578,460 B2 * 6/2003 Sartori ..... 83/102.1 X

* cited by examiner

*Primary Examiner*—Clark F. Dexter
(74) *Attorney, Agent, or Firm*—Bacon & Thomas

(57) ABSTRACT

A quick-detachable blade guard mounting structure. The structure includes a mounting frame, a holding down member defining with one side of the mounting frame, a gap, a blade guard holder member insertable into the gap, a stop device adapted for stopping the blade guard holder member in the gap, a lever pivoted to the holding down member and adapted for moving between a first position to unlock the blade guard holder member and a second position to lock the blade guard holder member.

7 Claims, 11 Drawing Sheets

F 1G. 10

QUICK-DETACHABLE BLADE GUARD MOUNTING STRUCTURE

BACKGROUND OF THE INVENTION

1. Field of the Invention

The present invention relates to a table saw and, more specifically, to a quick-detachable blade guard mounting structure for table saw.

2. Description of the Related Art

A table saw is provided with a movable saw blade guard adapted for protecting the saw blade when not in operation. During the operation of the table saw, the saw blade guard is lifted and placed at one side. When the table saw turned off, the saw blade guard is closed to mask the saw blade.

FIG. 1 illustrates a table saw constructed according to the prior art. According to this design, the worktable 1 has an elongated slot through which the saw blade 2 protrudes over the top side of the worktable 1. A holder frame 3 is provided at one end of the elongated slot. A blade guard 4 is pivoted to the holder frame 3 and adapted for protecting the saw blade 2. The holder frame 3 has two longitudinal coupling slots 5 coupled to respective screw rods (not shown) at the bottom side of the worktable 1. Two lock nuts 6 are respectively threaded onto the screw rods to lock the holder frame 3. When fastened up, the lock nuts 6 force the holder frame 3 against the saw blade holder to which the saw blade 2 is pivoted. In order to save storage space during delivery of the table saw, the holder frame 3 shall be detached from the worktable 1. However, during mounting or dismounting of the holder frame 3, a tool should be used and inserted into the elongated slot of the worktable 1 to rotate each lock nut 6 forwards or backwards. Therefore, it takes much time to mount/dismount the holder frame 3.

SUMMARY OF THE INVENTION

The present invention has been accomplished under the circumstances in view. It is therefore the main object of the present invention to provide a quick-detachable blade guard mounting structure, which enables the user to mount/dismount the saw blade guard quickly without the use of any tools.

To achieve this object of the present invention, the quick-detachable blade guard mounting structure comprises a mounting frame. A holding down member is provided at one end of the mounting frame and defines with the mounting frame a gap. The holding down member has a locating hole. A blade guard holder member is adapted for inserting into the gap and has a mounting hole and at least one stop portion in a lower part thereof. At least one stop device is adapted to stop the at least one stop portion of the blade guard holder member to hold the flat blade guard holder member in the gap in a predetermined position where the mounting hole of the flat blade guard holder member is axially aligned with the locating hole of the holding down member. A lever is pivoted to an outer side of the holding down member and moved relative to the holding down member between a first position and a second position. The lever has a first stop portion, which is aligned with the locating hole of the holding down member when the lever moved to the first position, and a second stop portion, which is aligned with the locating hole of the holding down member when the lever moved to the second position. A locking member is provided between the lever and the holding down member and has a shank and a head at one end of the shank. The shank is engaged into the locating hole of the holding down member when the head stopped at the first stop portion of the lever. The shank is engaged into the gap and the mounting hole of the flat blade guard holder member when the head stopped at the second stop portion of the lever. A spring member is provided between the holding down member and the lever and adapted for pushing the head the locking member toward the lever.

DETAILED DESCRIPTION OF THE PREFERRED EMBODIMENT

Figure 1:
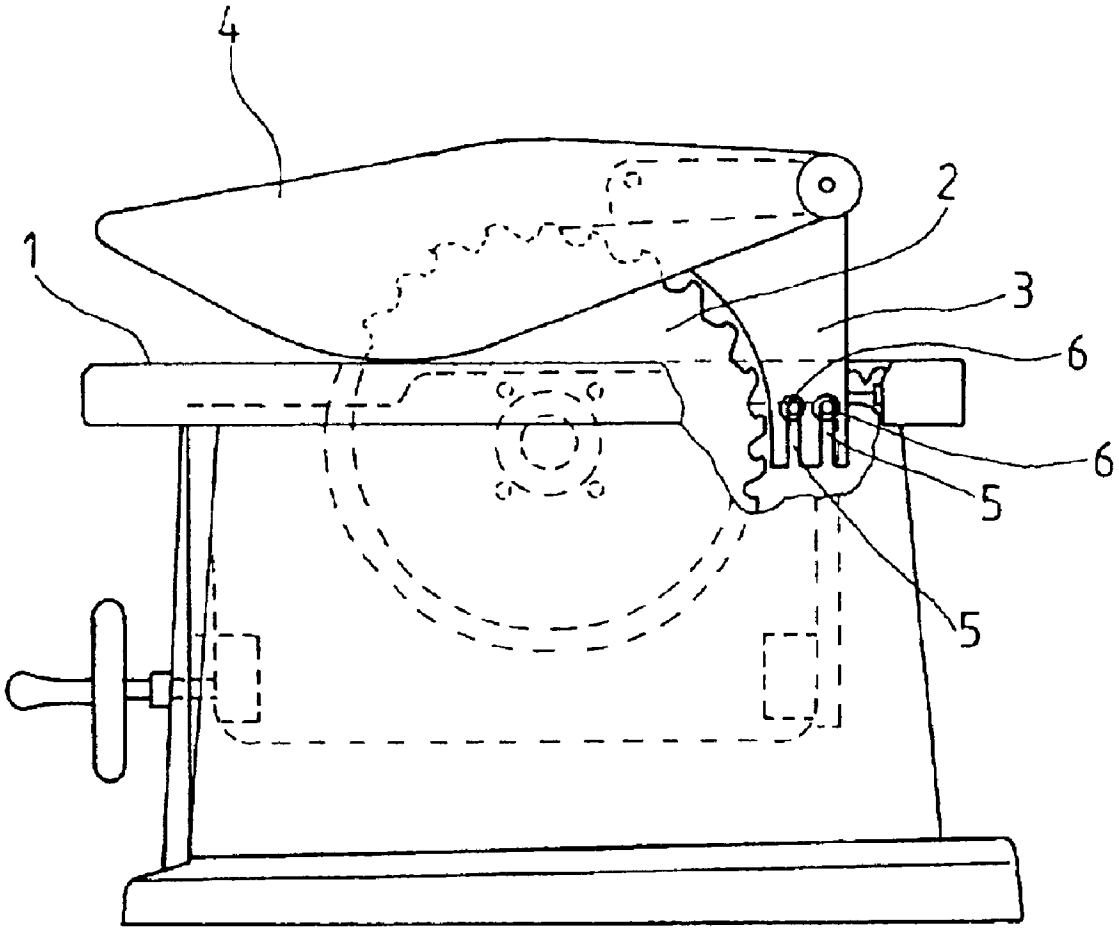
FIG. 1 PRIOR ART
FIG. 1 is a schematic drawing showing a table saw constructed according to the prior art.

Referring to FIGS. from 2 through 6, a quick-detachable blade guard mounting structure is a part of a table saw, comprising mounting frame 10, a holding down member 20, two cushions 30, a lever 40, two screw rods 50;50', a locking member 60, a spring member 70, and a blade guard holder member 80.

The mounting frame 10 is mounted in the bottom side of the table of the table saw, having a pivot hole 11 in one side thereof for the mounting of a saw blade. The mounting frame 10 can be adjusted upwards to hold the saw blade in the cutting position partially above the top side of the table of the table saw, or downwards to hold the saw blade in the received position below the table of the table saw. The mounting frame 10 further comprises a vertical wall 12 extended from one side thereof remote from the pivot hole 11, and two through holes 13;14 horizontally extended through the vertical wall 12.

Figure 5:
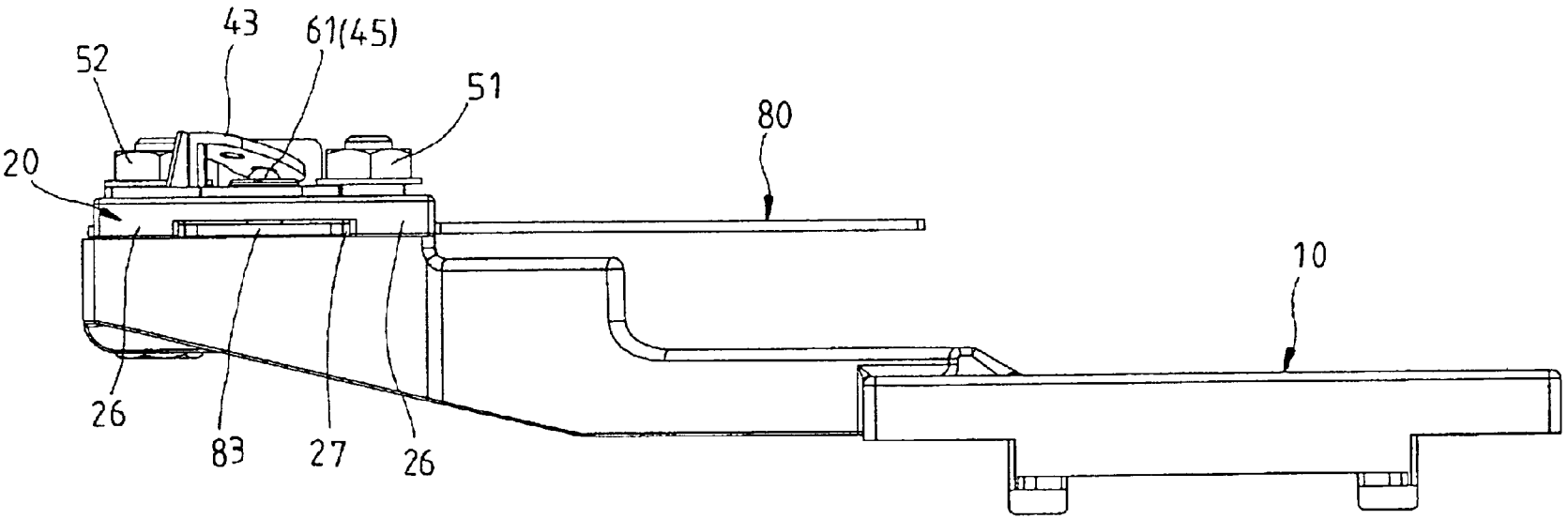
FIG. 5 is a bottom view of FIG. 3.
Figure 8:
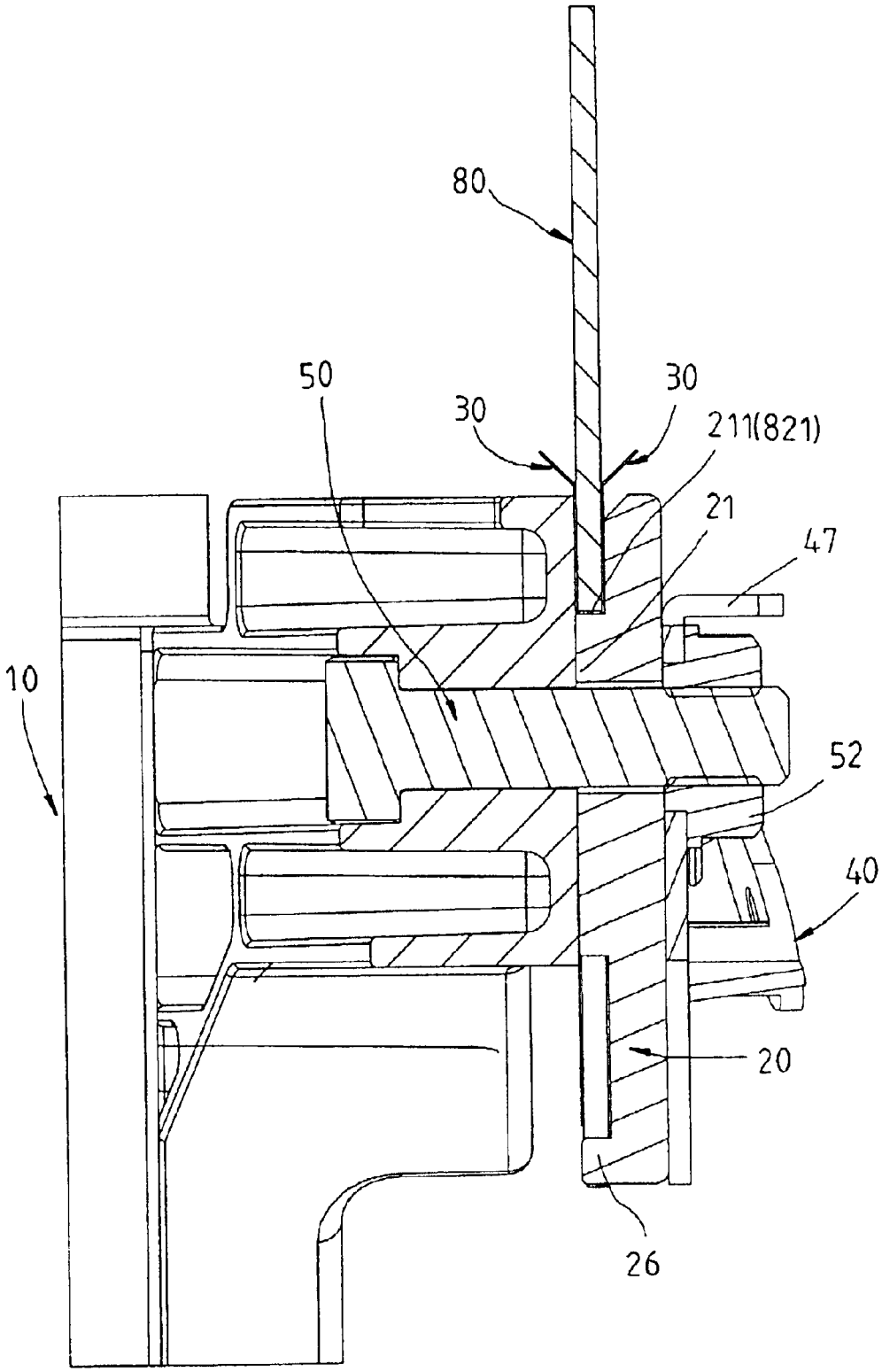
FIG. 8 is a sectional view taken along line 8—8 of FIG. 4.

The holding down member 20 is a plate member of certain thickness vertically disposed at an outer side relative to the vertical wall 12 of the mounting frame 10, having two longitudinal blocks 21 protruded from the back sidewall thereof (see FIG. 8), two conical stop portions 211 respectively protruded from the top sides of the longitudinal blocks 21, a locating hole 22 through the outer and inner sidewalls thereof between the longitudinal blocks 21, two through holes 23;24 respectively extended through the longitudinal blocks 21, a flange 25 protruded from the outer sidewall around the locating hole 22, two bottom flanges 26 bilaterally forwardly extended from the bottom side thereof at right angles and facing the mounting frame 10, and an opening 27 defined between the bottom flanges 26 (see FIG. 5).

Figure 6:
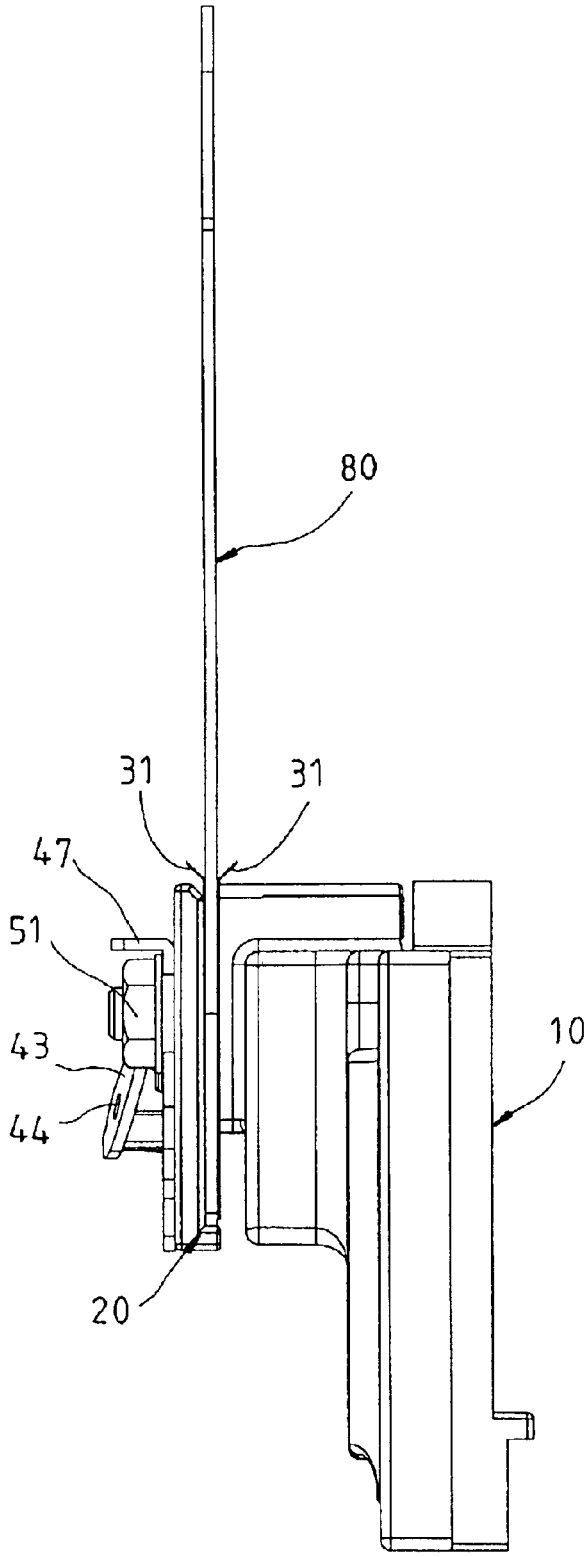
FIG. 6 is a side view of FIG. 3.

The cushions 30 are plate members of thin thickness, each having a top side bent at 45° into a sloping guide face 31, a circular through hole 32 at the center corresponding to the locating hole 22 of the holding down member 20, and two through holes 33;34 equally spaced from the circular through hole 32 at two sides corresponding to the through holes 23;24 of the holding down member 20. The through holes 33;34 are slightly greater than the longitudinal blocks 21 of the holding down member 20. During installation, the cushions 30 are placed in between the vertical wall 12 of the mounting frame 10 and the holding down member 20 and reversely arranged in parallel, such that the sloping guide faces 31 define a substantially hopper-like mouth (see FIG. 6) after the longitudinal blocks 21 have been respective engaged into the through holes 33;34.

Figure 7:
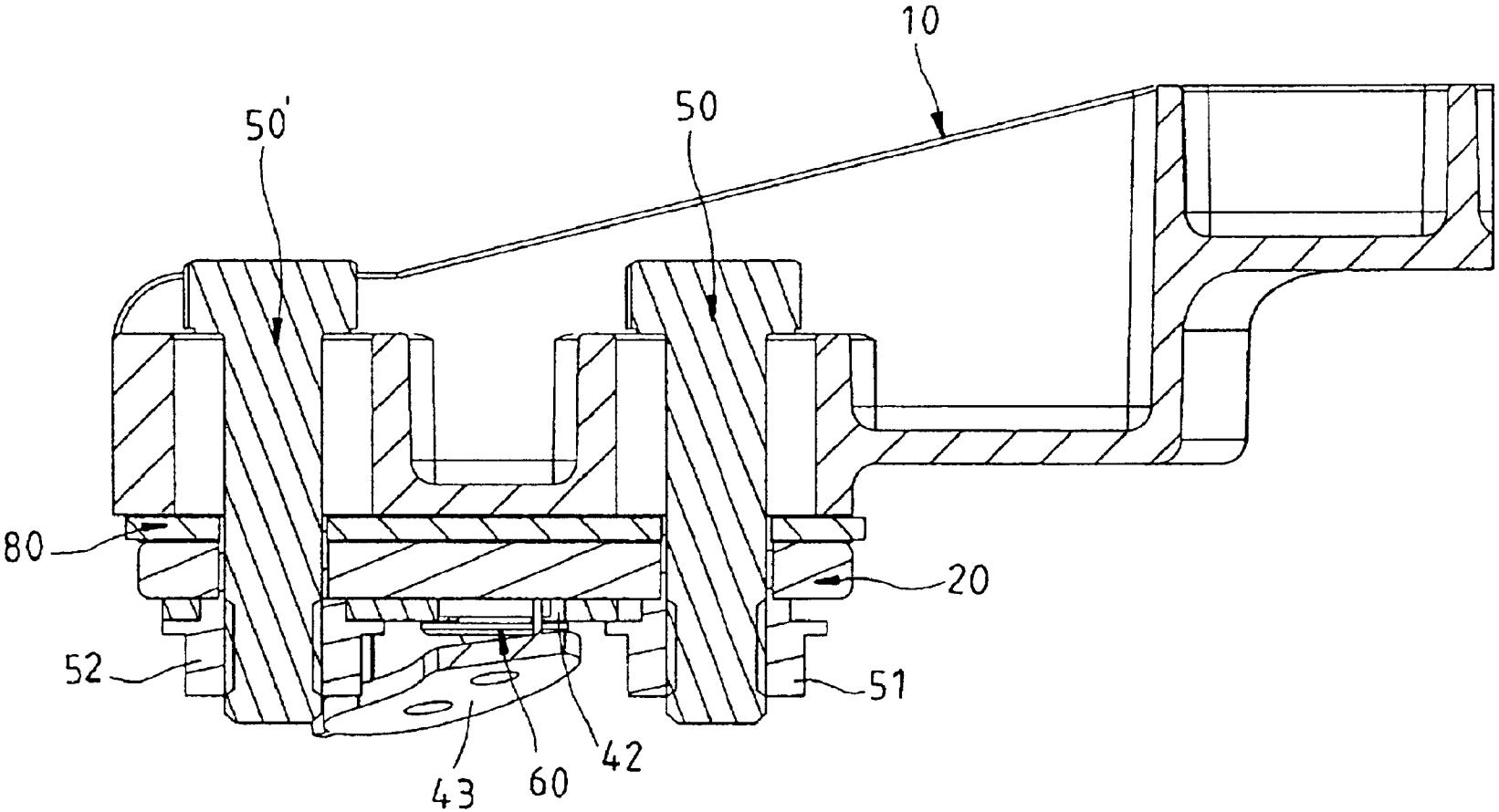
FIG. 7 is a sectional view taken along line 7—7 of FIG. 4.
Figure 9:
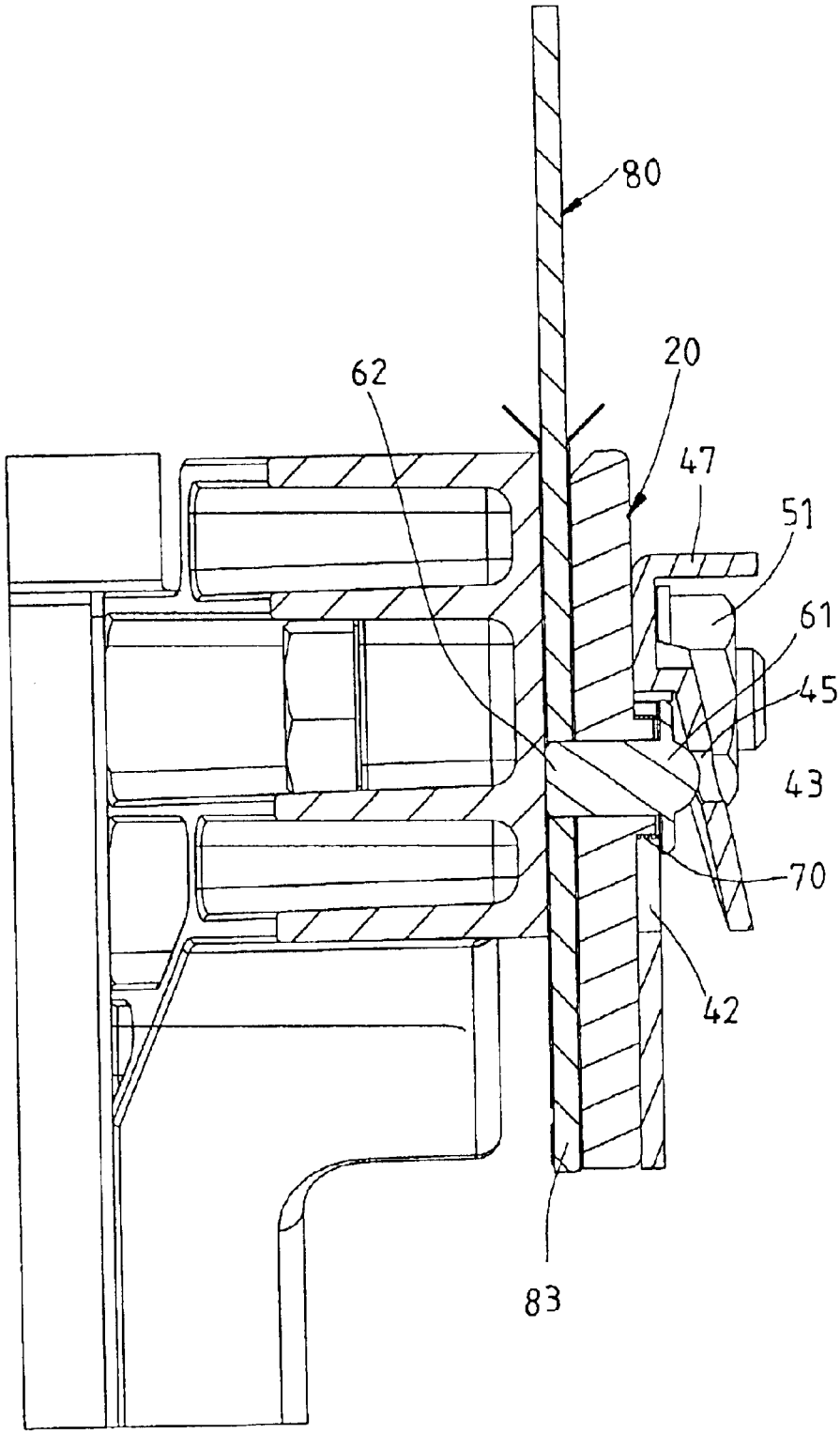
FIG. 9 is a sectional view taken along line 9—9 of FIG. 4.

The lever 40 is provided at an outer side of the holding down member 20 opposite to the cushions 30, having a pivot hole 41 disposed in one end thereof, an arched slot 42 (see FIGS. 7 and 9), a stop strip 43 obliquely downwardly extended from one side thereof adjacent to the arched slot 42, a first eyeleted stop portion 44 disposed in the stop strip 43 at a lower location relatively farther from the arched slot 42, a second eyeleted stop portion 45 disposed in the stop strip 43 at a higher location relatively closer to the arched slot 42, a smoothly arched bearing portion 46 disposed in the other end thereof remote from the pivot hole 41, and a horizontal finger strip 47 outwardly extended from the top side thereof.

Figure 4:
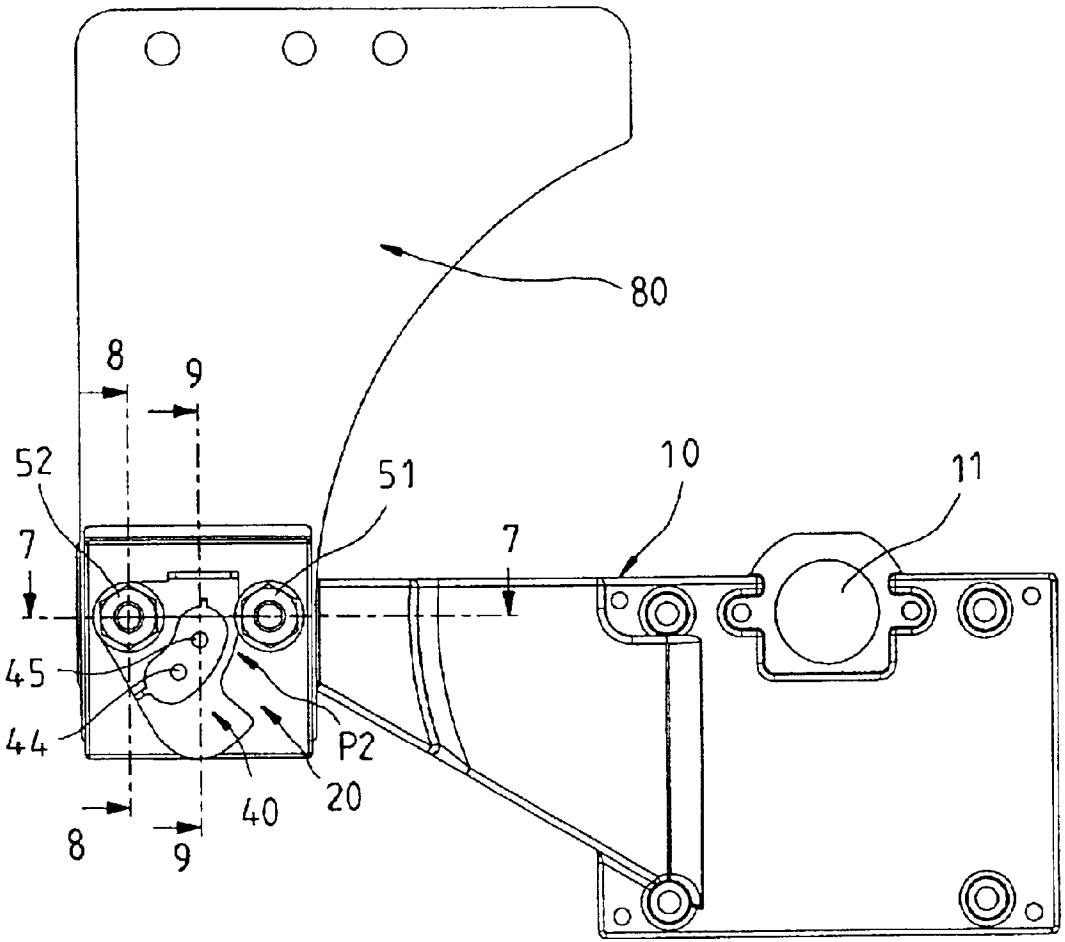
FIG. 4 is a front view of FIG. 3 showing the lever moved to the second position (the blade guard holder member locked).
Figure 10:
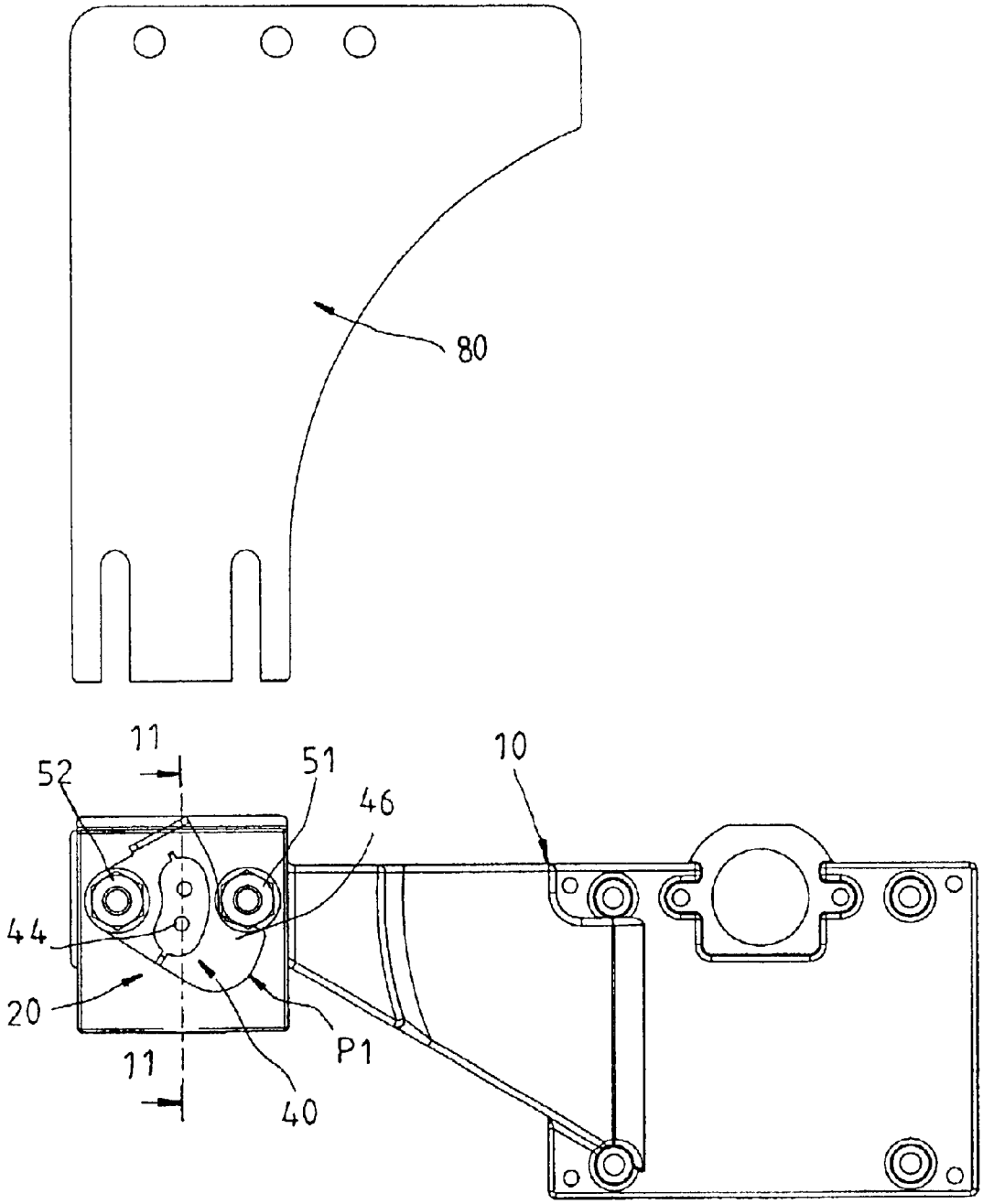
FIG. 10 is a front view of the quick-detachable blade guard mounting structure showing the lever moved to the first position and the blade guard holder member disconnected from the mounting frame.

The two screw rods 50;50' are respectively inserted in proper order through the through holes 13;14 of the mounting frame 10, the through holes 33;34 of the cushions 30, and the through holes 23;24 of the holding down member 20, and then the first screw rod 50 is directly screwed up with a first nut 51 and, the second screw rod 50' is inserted through the pivot hole 41 of the lever 40 and screw up with a second nut 52. Thus, the lever 40 can be turned about the axis passing through the pivot hole 41 between the first position P1 (see FIG. 10) and the second position P2 (see FIG. 4). The engagement of the screw rods 50;50' with the nuts 51;52 keeps the lever 40, the holding down member 20 and the cushions 30 closely attached to the vertical wall 12 of the mounting frame 10, and also keeps the circular through holes 32 of the cushions 30 in line with the locating hole 22 of the holding down member 20 and one eyeleted stop portion 44 or 45 of the lever 40.

Figure 2:
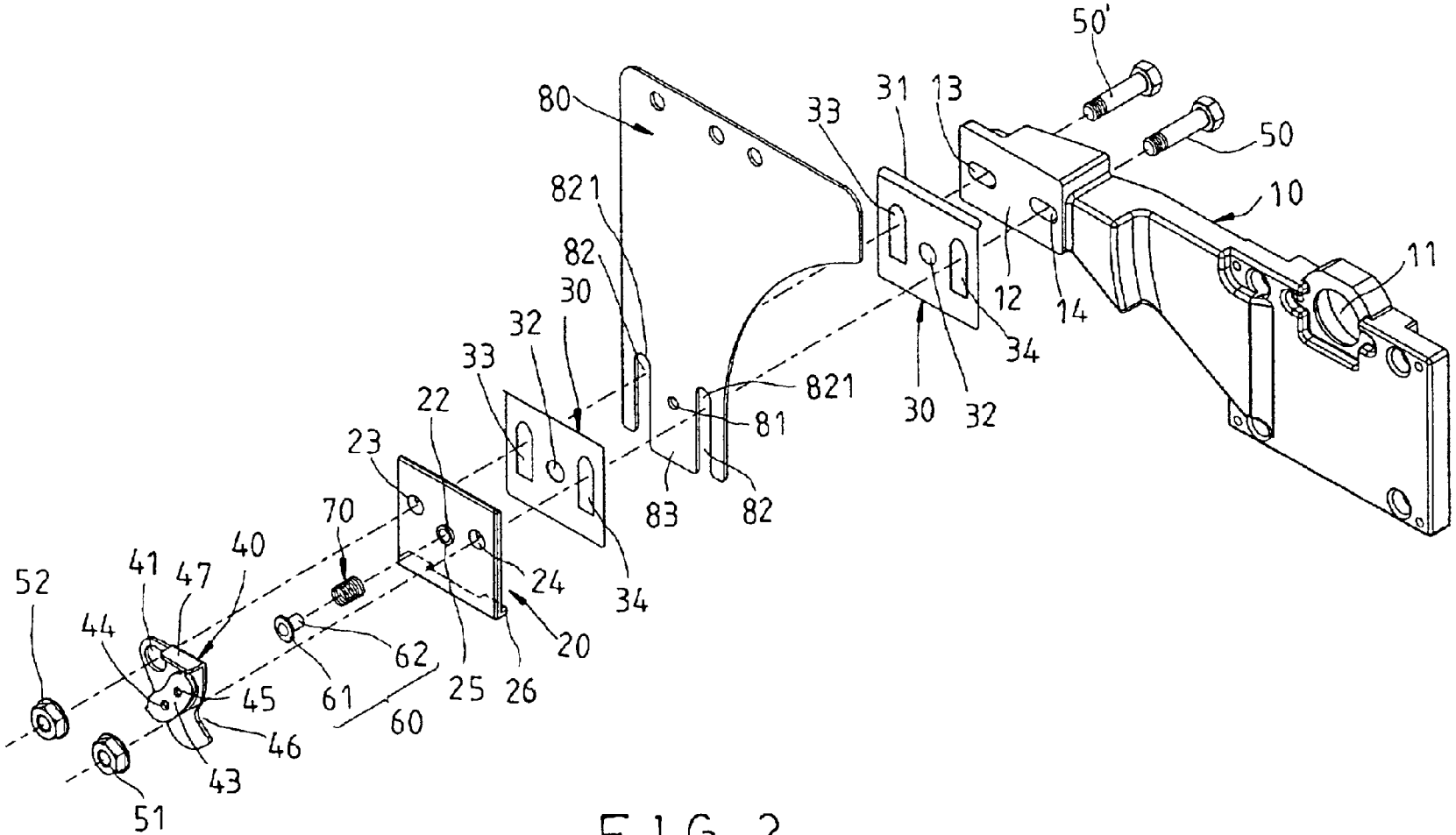
FIG. 2 is an exploded view of a quick-detachable blade guard mounting structure according to the present invention.
Figure 3:
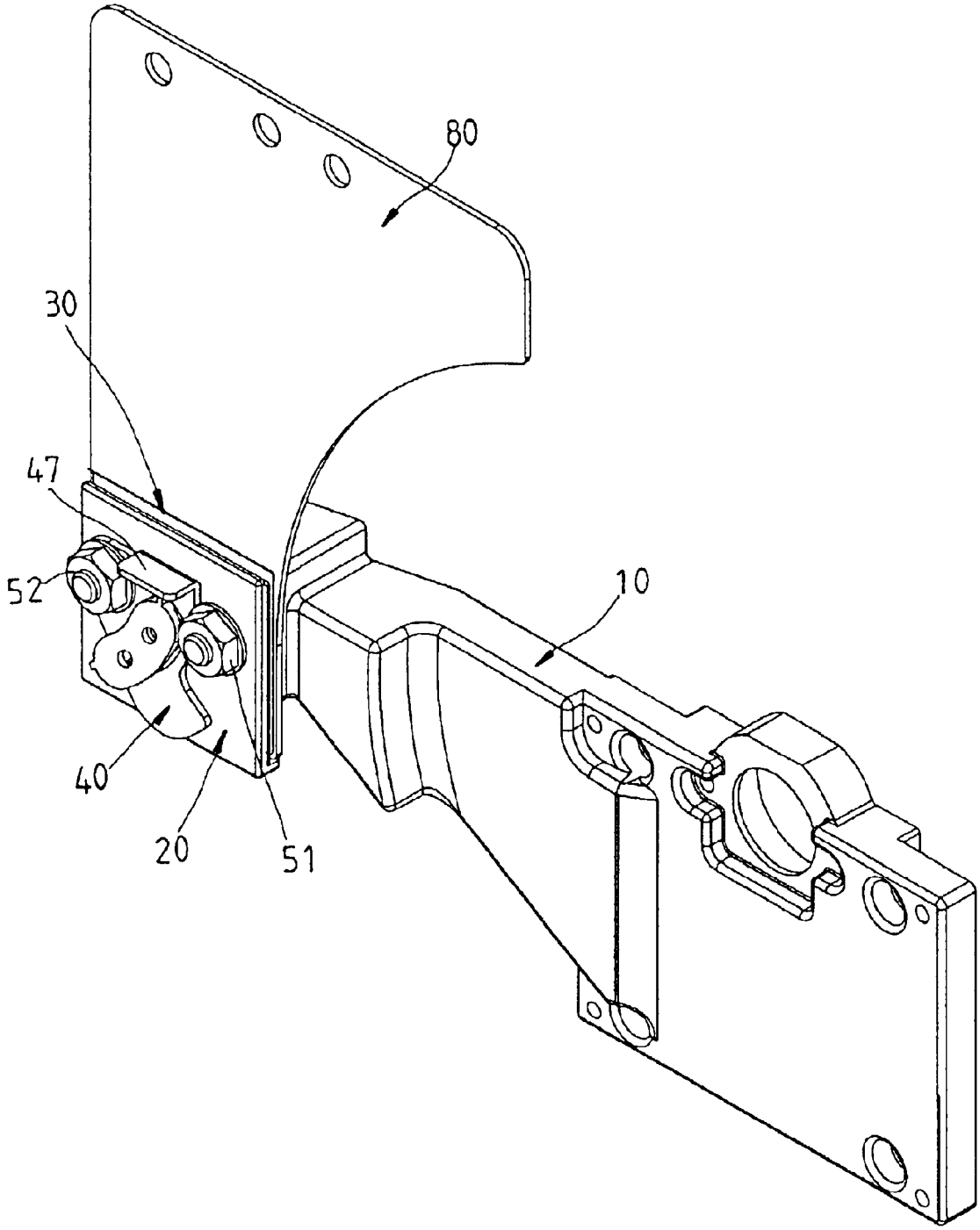
FIG. 3 is an assembly view of the quick-detachable blade guard mounting structure according to the present invention.
Figure 11:
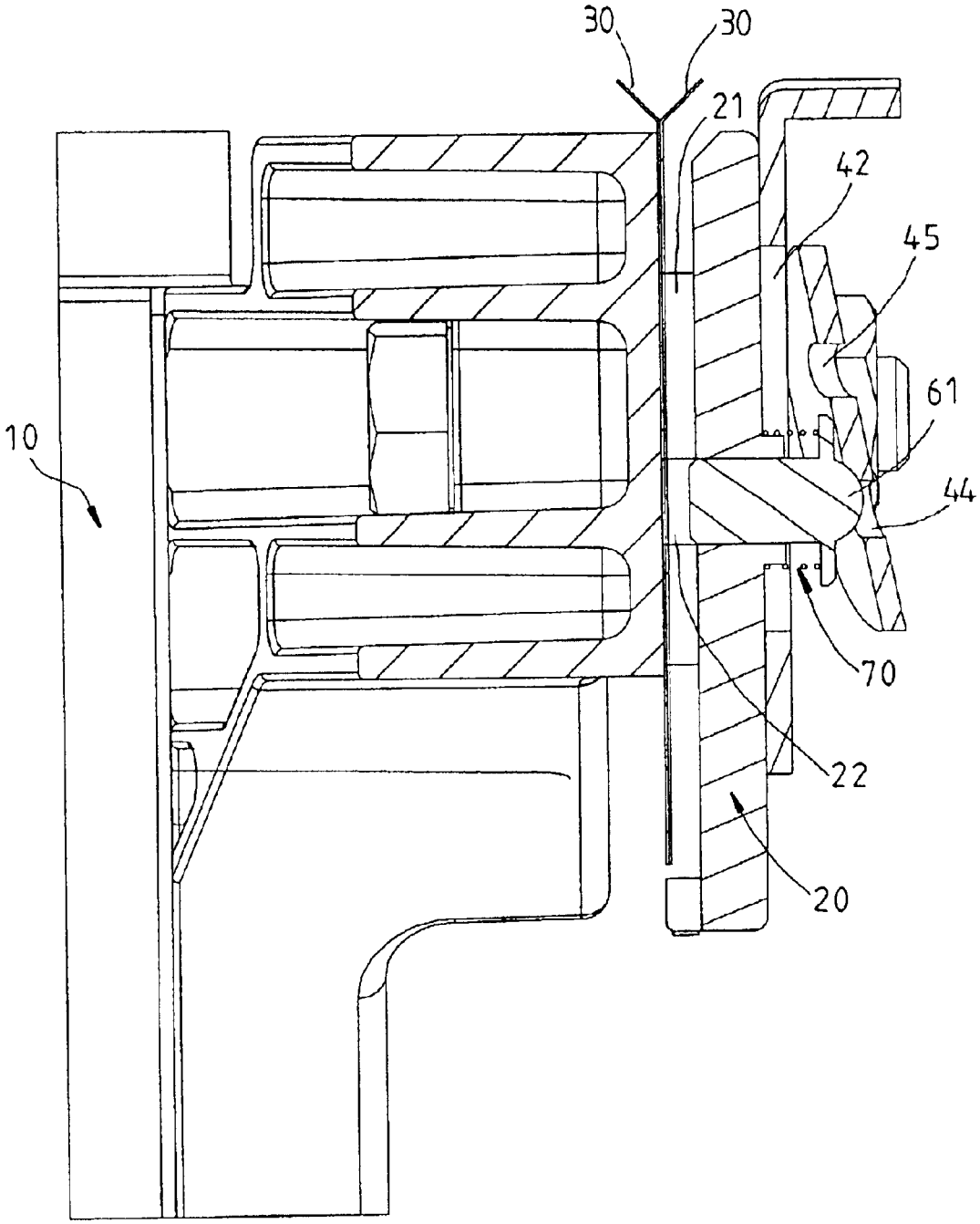
FIG. 11 is a sectional view taken along line 11—11 of FIG. 10.

The locking member 60 and the spring member 70 are provided between the lever 40 and the holding down member 20, as shown in FIG. 2. The locking member 60 comprises a shank 62 and a cone head 61 at one end of the shank 62. The spring member 70 is a compression spring 70 sleeved onto the shank 62 of the locking member 60 and stopped between the head 61 of the locking member 60 and the flange 25 of the holding down member 20, imparting an outward pressure to the head 61 of the locking member 60 toward the lever 40. When the smoothly arched bearing portion 46 of the lever 40 touched the first nut 51, the lever 40 is moved to the first position P1, at this time the head 61 is stopped at the first eyeleted stop portion 44, and the shank 62 of the locking member 60 is inserted into the locating hole 22 of the holding down member 20 (see FIG. 11). When the lever 40 moved to the second position P2, the head 61 is stopped at the second eyeleted stop portion 45, and the shank 62 is extended toward the mounting frame 10 farther.

Because of the arrangement of the spring member 70, the gap between the cushions 30 varies with the compression status of the spring member 70.

The blade guard holder member 80 is a flat coupling plate. The upper part of the blade guard holder member 80 is adapted for receiving a blade guard (not shown). The lower part of the blade guard holder member 80 comprises two longitudinal guide slots 82 arranged in parallel and extended to the bottom side thereof, a suspension portion 83 defined between the longitudinal guide slots 82, and a mounting hole 81 disposed in the front suspension portion 83. The bottom side of each longitudinal guide slot 82 is an open end. The top side of each longitudinal guide slot 82 is a close end, which forms a stop edge 821.

Before inserting the lower part of the blade guard holder member 80 into the gap between the cushions 30, the lever 40 is shifted to the first position P1, and then the bottom edge of the blade guard holder member 80 is aimed at the hopper-like mouth defined between the sloping guide faces 31 of the cushions 30, keeping the bottom open sides of the longitudinal guide slots 82 aligned with the longitudinal blocks 21 of the holding down member 20. Thus, the blade guard holder member 80 can be smoothly moved into position. When the stop edges 821 of the longitudinal guide slots 82 respectively stopped at the conical stop portions 211 of the longitudinal blocks 21 (see FIG. 8), the blade guard holder member 80 is prohibited from downward movement, and the front suspension portion 83 is plugged into the opening 27 between the bottom flanges 26 (see FIG. 5). When pushing the finger strip 47 to move the lever 40 from the first position P1 to the second position P2 at this time, the stop strip 43 will force the locking member 60 toward the mounting frame 10, thereby causing the head 61 of the locking member 60 to be stopped at the second eyeleted stop portion 45 and the shank 62 engaged into the locating hole 22 and the mounting hole 81 to lock the blade guard holder member 80. On the contrary, when removing the blade guard holder member 80, push the finger strip 47 to move the lever 40 from the second position P2 to the first position P1. When shifted to the first position P1, the locking member 60 is forced by the spring member 70 to disengage the shank 62 from the mounting hole 81 and to stop the head 61 at the first eyelet stop portion 44, for enabling the user to remove the blade guard holder member 80 from the mounting frame 10.

Further, when inserting the blade guard holder member 80 into the gap between the cushions 30, the bottom flanges 26 of the holding down member 20 support the blade guard holder member 80 in position.

As indicated above, the quick-detachable blade guard mounting structure achieves numerous advantages as outlined hereinafter.

1. By means of shifting the lever 40 between the first position P1 (see FIGS. 10 and 11) and the second position P2 (see FIGS. 4 and 9), the blade guard holder member 80 is locked/unlocked. Therefore, it is not necessary to use any tools to lock/unlock the blade guard holder member 80.
2. The longitudinal blocks 21 guide the front suspension portion 83 of the blade guard holder member 80 accurately into the opening 27 between the bottom flanges 26, preventing vibration of the blade guard holder member 80.
3. The parts of the blade guard mounting structure are simple and inexpensive to manufacture. When assembled, the blade guard holder member 80 can easily quickly be installed and locked.
4. By means of adding additional cushion(s) to the gap between the blade guard holder member 80 and the vertical wall 12 of the mounting frame 10 to change the position of the blade guard holder member 80 relative to the mounting frame 10, the blade guard can be adjusted to the center position in perfect alignment with the saw blade.

While only one embodiment of the present invention has been shown and described, it will be understood that various modifications and changes could be made thereunto without departing from the spirit and scope of the invention disclosed.

What the invention claimed is:

1. A quick-detachable blade guard mounting structure comprising:

a mounting frame for supporting a cutting blade;

a holding down member provided at one end of said mounting frame and defining with said mounting frame a gap, said holding down member comprising a locating hole;

a blade guard holder member positioned in said gap between said mounting frame and said holding down member, said blade guard holder member having a mounting hole and at least one stop portion in a lower part thereof;

the holding down member further comprising at least one stop device that positions the at least one stop portion of said blade guard holder member in said gap in a predetermined position where the mounting hole of said blade guard holder member is axially aligned with the locating hole of said holding down member;

a lever pivoted to an outer side of said holding down member and moved relative to said holding down member between a first position and a second position, said lever having a first stop portion, which is aligned with the locating hole of said holding down member when said lever is moved to said first position, and a second stop portion, which is aligned with the locating hole of said holding down member when said lever is moved to said second position;

a locking member is provided between said lever and said holding down member, said locking member having a shank and a head at one end of said shank, said shank being engaged into said locating hole of said holding down member when said head is stopped at said first stop portion of said lever, said shank being engaged into said mounting hole of said blade guard holder member when said head stopped at said second stop portion of said lever; and a spring member provided between said holding down member and said lever and said spring member pushes the head of said locking member towards said lever.

2. The quick-detachable blade guard mounting structure as claimed in claim 1, wherein said mounting frame comprises a vertical wall disposed at one side thereof, a first through hole extended through said vertical wall, and a second through hole extended through said vertical wall; said holding down member comprises a first through hole aligned with the first through hole of said mounting frame, and a second through hole fastened to the second through hole of said mounting frame by a first screw rod and a first nut; said lever comprises a pivot hole pivotally coupled to the first through hole of said holding down member and the first through hole of said mounting frame by a second screw rod and a second nut.

3. The quick-detachable blade guard mounting structure as claimed in claim 2, wherein said blade guard holder member comprises two longitudinal guide slots arranged in parallel and downwardly extended to a bottom side thereof, said longitudinal guide slots each having a bottom end opened and a top end terminating in the at least one stop portion of said blade guard holder member; said at least one stop device of said holding down member comprises two longitudinal blocks protruded from one side thereof that engage into the longitudinal guide slots of said blade guard holder member to guide said blade guard holder member into said gap between said mounting frame and said holding down member, said longitudinal blocks each having a top stop portion that stops the at least one stop portion of said blade guard holder member to limit downward movement of said blade guard holder member.

4. The quick-detachable blade guard mounting structure as claimed in claim 2, wherein said lever comprises an arched slot, and a stop strip obliquely downwardly extended from one side thereof adjacent to said arched slot, said first stop portion comprises a first eyeleted stop portion disposed in said stop strip at a lower location relatively farther from the arched slot of said lever, said second stop portion comprises a second eyeleted stop portion disposed in said stop strip at a higher location relatively closer to the arched slot of said lever, and a smoothly arched bearing portion disposed in an opposite end thereof and stops said second nut to hold said lever in said first position.

5. The quick-detachable blade guard mounting structure as claimed in claim 4, wherein said lever further comprises a finger strip outwardly extended from a top side thereof.

6. The quick-detachable blade guard mounting structure as claimed in claim 2, further comprising two cushions provided between said mounting frame and said holding down member, said cushions each comprising a center through hole aligned with the locating hole of said holding down member, two side through holes respectively aligned with the through holes of said holding down member and the through holes of said mounting frame and coupled to said screw rods, and a sloping guide face, the sloping guide faces of said cushions defining a substantially hopper-like mouth adapted for guiding said blade guard holder member into said gap between said mounting frame and said holding down member.

7. The quick-detachable blade guard mounting structure as claimed in claim 1, wherein said holding down member comprises a flange extended around said locating hole; said spring member is a compression spring sleeved onto the shank of said locking member and stopped between the flange of said holding down member and the head of said locking member.

* * * * *